US008834654B1

(12) United States Patent
Lustig, Jr.

(10) Patent No.: US 8,834,654 B1
(45) Date of Patent: Sep. 16, 2014

(54) REACTIVE POLYUREHTHANE ADHESIVE FOR EXPLOSIVE TO METAL BONDING

(75) Inventor: Edward A. Lustig, Jr., Charlotte Hall, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 227 days.

(21) Appl. No.: 12/799,011

(22) Filed: Mar. 31, 2010

(51) Int. Cl.
*C06B 45/12* (2006.01)

(52) U.S. Cl.
USPC ..... 149/14; 149/109.6

(58) Field of Classification Search
CPC ..... C06B 47/145; C06B 21/0008; C06B 21/0091; C06B 25/04; C06B 45/21
See application file for complete search history.

(56) References Cited

U.S. PATENT DOCUMENTS

| | | | | |
|---|---|---|---|---|
| 3,185,089 | A | 5/1965 | Parkhurst et al. | |
| 4,209,351 | A | 6/1980 | Pierce et al. | |
| 5,247,000 | A | 9/1993 | Allan | |
| 5,272,785 | A | 12/1993 | Stegens | |
| 5,377,593 | A * | 1/1995 | Boothe et al. | 102/289 |
| 5,417,895 | A * | 5/1995 | Oberth | 264/3.1 |
| 5,767,221 | A | 6/1998 | Poulter et al. | |
| 2007/0251615 | A1 | 11/2007 | Amtower, II | |

* cited by examiner

*Primary Examiner* — Aileen B Felton
(74) *Attorney, Agent, or Firm* — Fredric J. Zimmerman

(57) ABSTRACT

An adhesive may bond a plastic bonded explosive to a metal surface. The adhesive may include a mixture of hydroxyl-terminated polybutadiene (HTPB) and isophorone di-isocyanate (IPDI) in a weight ratio in the range of about 5 to 1 to about 10 to 1. The adhesive may include a solvent and/or a catalyst.

6 Claims, 1 Drawing Sheet

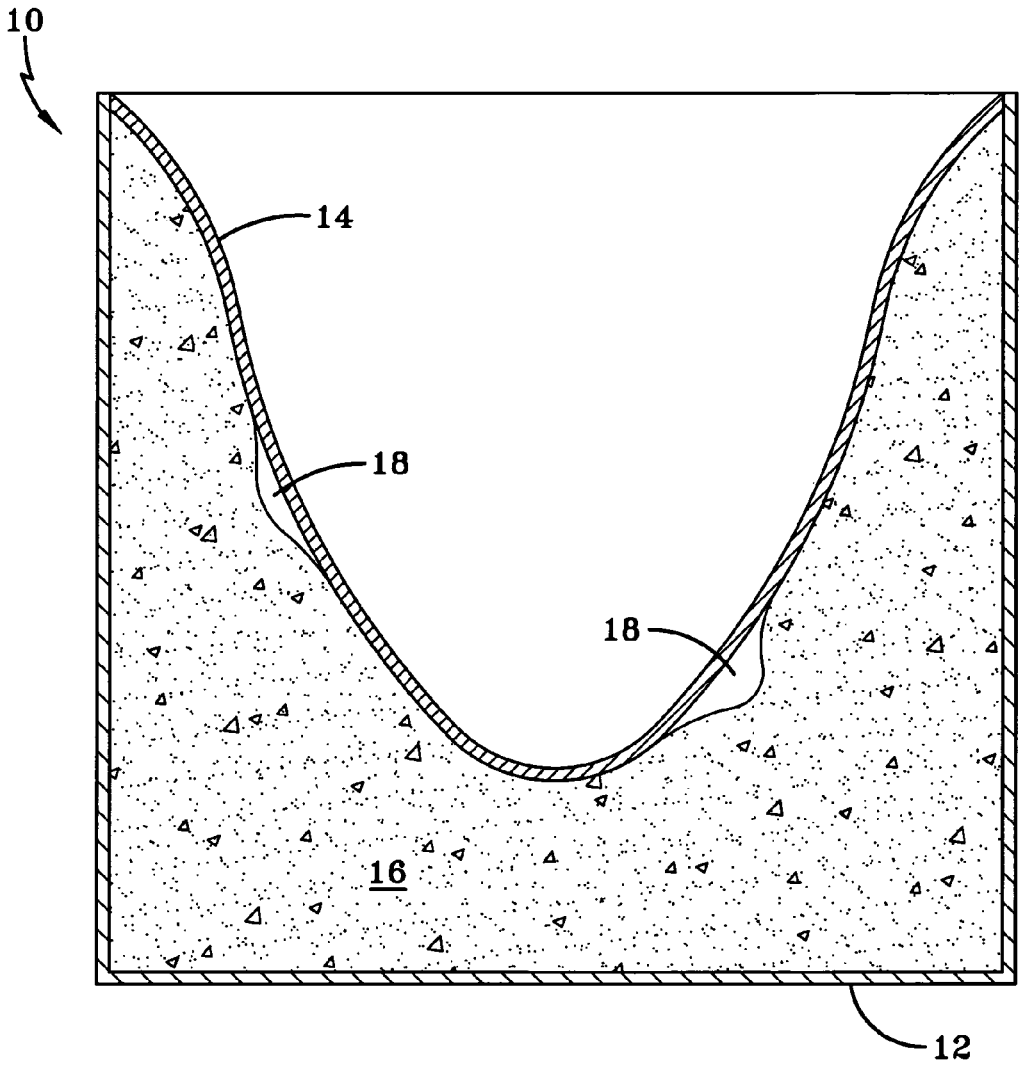
CONVENTIONAL ART

REACTIVE POLYUREHTHANE ADHESIVE FOR EXPLOSIVE TO METAL BONDING

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The invention relates, in general, to adhesives, and, in particular, to adhesives for bonding explosive mixtures to metal surfaces.

BACKGROUND OF THE INVENTION

In some apparatus, there may be a need for a bond between an explosive mixture and a metal surface. For example, a shaped charge may include explosive material disposed between an outer case and a metal liner. The FIGURE shows a conventional shaped charge 10 with an outer case 12, a metal liner 14, and explosive material 16 disposed between the outer case 12 and the metal liner 14. A shaped charge 10 may not perform properly if there are gaps 18 between the explosive material 16 and the metal liner 14.

A method of adhering explosive material directly to the metal surface of a shaped charge liner has not been known. In the past, the metal surface of the liner was cleaned with a solvent prior to casting the explosive material into the outer case. Also, a release agent was applied to the inner surface of the outer case. These measures were expected to cause the explosive material to release from the case during curing and adhere to the metal liner. However, gaps may still occur between the explosive material and the metal liner. Thus, a need exists for a method of adhering explosive material directly to a metal surface.

SUMMARY OF THE INVENTION

Accordingly, it is an object of the present invention to provide an adhesive for bonding a plastic bonded explosive to a metal surface.

Another object of the present invention is to provide a method for adhering an explosive material to a metal surface.

In accordance with the present invention, an adhesive is provided for bonding a plastic bonded explosive to a metal surface. The adhesive consists essentially of a mixture of hydroxyl-terminated polybutadiene (HTPB) and isophorone di-isocyanate (IPDI) in a weight ratio in a range of about 5 to 1 to about 10 to 1, and a solvent. The present invention also provides for a method of adhering a plastic bonded explosive to a metal surface, including providing the above describe adhesive, and applying the adhesive to a metal surface The invention will be better understood, and further objects, features, and advantages thereof will become more apparent from the following description of the exemplary embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

The FIGURE is a schematic side view of a conventional shaped charge.

DETAILED DESCRIPTION OF THE INVENTION

An adhesive for bonding a plastic bonded explosive to a metal surface may include a mixture of hydroxyl-terminated polybutadiene (HTPB) and isophorone di-isocyanate (IPDI) in a weight ratio in the range of about 5 to 1 to about 10 to 1. In one embodiment, the weight ratio of HTPB to IPDI is about 7 to 1. Weight ratios of HTPB to IPDI in the range of about 5 to 1 to about 10 to 1 create NCO/OH ratios in the range of about 2.0 to about 1.0. The weight ratio of HTPB to IPDI of about 7 to 1 creates an NCO/OH ratio of approximately 1.5.

The adhesive may also include a solvent, such as acetone or toluene, for example. The solvent may be, for example, about 30% to about 50%, by weight, of the adhesive.

The HTPB/IPDI mixture may be, for example, about 50% to about 70%, by weight, of the adhesive. A catalyst, for example, dibutyltin dilaurate (DBTDL), may be added to the adhesive to accelerate the curing time.

The adhesive may be thoroughly mixed in a temperature range of about 150° F. to about 200° F. In one embodiment, the adhesive is mixed at about 175° F. The adhesive may be applied to metal surfaces by dipping. The adhesive may be allowed to partially cure at about 125-150° F. for about 72-96 hours. Explosive material may be cast on top of the partially cured adhesive.

The adhesive may include excess isocyanate functionality and the explosive material may include excess hydroxyl functionality, which may create a reactive interface between the two polymeric phases. During curing of the explosive material, the adhesive may react with components of the explosive material binder system and may create a strong chemical bond. In addition, the adhesive may bond well to metal surfaces.

The amount of solvent in the adhesive may be varied. For adhering plastic bonded explosive material to a metal liner in a shaped charge, a thin layer of the adhesive may be applied to the metal liner surface. A thin layer of adhesive may be desirable on a shaped charge liner so that the adhesive does not affect the performance of the shaped charge. An exemplary layer of adhesive may have a thickness, for example, in a range of about 0.0001 inches to about 0.01 inches. In one embodiment, the thickness of the adhesive is about 0.001 inches.

In some exemplary embodiments, additives that may thicken the adhesive may not be used. In other exemplary embodiments, additives that may affect the interaction of the detonation wave with the metal liner may not be used. In conventional technology, coatings for rockets may include additives, for example, carbon, that may strengthen the rocket coating. In an exemplary embodiment of the inventive adhesive, additives that may strengthen the adhesive may not be used.

EXAMPLE

A mixture containing 87.72% HTPB and 12.28% IPDI was used in lap shear testing. The mixture was applied between two pairs of metal strips. Each pair of metal strips were squeezed together with clamps and cured for 96 hours at 175° F. The lap shear test demonstrated a bond strength of the mixture between 300 and 500 psi. This strength is well in excess of the material strength of an explosive such as PBXN-110.

Lap shear tests were performed using PBXN-110 sandwiched between a pair of metal strips that were uncoated in one case, or coated with the mixture containing 87.72% HTPB and 12.28% IPDI, in another case. The five coated samples all failed within the explosive material, i.e., within the PBXN-110. The five uncoated samples all failed at the interface between the explosive material and the metal strips.

A mixture containing 87.72% HTPB and 12.28% IPDI was brought to 175° F. and a metal shaped charge liner was dipped in the mixture. The shaped charge liner remained in the mixture for 15 seconds. The liner was removed and allowed to drip with the apex side down for 15 seconds. The liner was placed base side down on a TEFLON coated baking sheet and cured in an oven at 125° F. for 72-96 hours. Sixteen measurements were made on the liner to determine coating thickness and uniformity. The thickness varied between 0.0003 inches and 0.00105 inches. These results were better than anticipated.

Two uncoated, metal shaped charge liners were cast with PBXN-110 explosive. Two identical shaped charge liners were coated with a mixture containing 87.72% HTPB and 12.28% IPDI, and after partial cure, were cast with PBXN-110 explosive. The performance of the four liners was evaluated using flash x-ray testing. The two coated liners formed straight coherent jets. The two uncoated liners formed jets that were not straight. The coating had no detrimental effect on the performance of the two coated liners. Also, because the uncoated liners did not perform as well as the coated liners, the coating may have had a beneficial effect on the liner performance.

Any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A method of adhering a plastic bonded explosive to a metal surface, comprising:

providing an adhesive, wherein the adhesive consists essentially of a mixture of hydroxyl-terminated polybutadiene (HTPB) and isophorone di-isocyanate (IPDI) in a weight ratio in a range of about 5 to 1 to about 10 to 1, and a solvent;

applying the adhesive to the metal surface; and partially curing the adhesive and casting explosive material on a partially cured said adhesive thereby forming a reactive interface intermediate the casting explosive and the partially cured said adhesive, wherein said applying the adhesive includes dipping the metal surface of a shaped charge, liner into the adhesive for forming a substantially uniform thin layer of the adhesive.

2. The method of claim 1, further comprising, after applying the adhesive, partially curing the adhesive at a temperature in a range of about 125° F. to about 150° F.

3. The method of claim 1, further comprising, after applying the adhesive, partially curing the adhesive for a time period in a range of about 72 hours to about 96 hours.

4. The method of claim 1, wherein a thickness of the adhesive is in a range of about 0.0001 inches to about 0.01 inches.

5. The method of claim 4, wherein the thickness of the adhesive is about 0.001 inches.

6. The method of claim 1, wherein said providing the adhesive includes providing the adhesive with the weight ratio of HTPB to IPDI-being about 7 to 1.

* * * * *